US006647653B1

(12) United States Patent
Hengstenberg

(10) Patent No.: US 6,647,653 B1
(45) Date of Patent: Nov. 18, 2003

(54) FIRING ELEMENT FOR MUZZLELOADING RIFLE

(75) Inventor: Eric T. Hengstenberg, Centerville, IA (US)

(73) Assignee: BBSCO Industries, Inc., Birmingham, AL (US)

( * ) Notice: Subject to any disclaimer, the term of this patent is extended or adjusted under 35 U.S.C. 154(b) by 0 days.

(21) Appl. No.: 10/145,463

(22) Filed: May 14, 2002

(51) Int. Cl.[7] ..... F41C 9/08
(52) U.S. Cl. ..... 42/51
(58) Field of Search ..... 42/51, 16; 89/1.3

(56) References Cited

U.S. PATENT DOCUMENTS

| | | | | |
|---|---|---|---|---|
| 4,700,499 A | | 10/1987 | Knight | |
| 5,307,583 A | * | 5/1994 | Mahn et al. | 42/51 |
| 5,408,776 A | * | 4/1995 | Mahn et al. | 42/51 |
| 5,487,232 A | * | 1/1996 | Osborne et al. | 42/51 |
| 5,606,817 A | | 3/1997 | Sachse | |
| 5,644,861 A | * | 7/1997 | Knight | 42/51 |
| 5,706,598 A | * | 1/1998 | Johnston | 89/1.3 |
| 5,737,863 A | * | 4/1998 | Rainey, III | 42/51 |
| 5,915,934 A | | 6/1999 | Knight et al. | |
| 5,915,938 A | | 6/1999 | Moore | |
| 6,311,421 B1 | * | 11/2001 | Knight | 42/51 |
| 6,385,887 B1 | * | 5/2002 | Johnston | 42/51 |

FOREIGN PATENT DOCUMENTS

| | | | | |
|---|---|---|---|---|
| FR | 584.454 | * | 2/1925 | 89/1.3 |

* cited by examiner

*Primary Examiner*—Stephen M. Johnson

(57) ABSTRACT

A muzzleloading firearm with a barrel having a rearward end with a breech plug fastened to the rearward end of the barrel, a nipple that extends rearwardly from the breech plug, a receiver positioned rearward of the barrel and having an opening for receiving a firing element, and having an elongated bore extending through from a forward end to a rearward end, the rearward end receives the percussion element and the forward end receives the nipple such that a forward end of the percussion element is in alignment with the nipple.

2 Claims, 3 Drawing Sheets

10
12
14
16
18
20
22
24
26
28

12
14
20
22
24
26
28
30
32
34
36
38
40
41
42
43
44
46
48
49
50
52
54
56
58
60
62

FIRING ELEMENT FOR MUZZLELOADING RIFLE

BACKGROUND OF THE INVENTION

This invention relates generally to rifles, and more particularly to an improved muzzleloading rifle.

Muzzleloading rifles have become popular in recent times due to improved ease of operation, increased skill required of the hunter, and the nostalgia of pouring powder down the barrel, packing the powder, and driving a shot down the barrel. While traditional muzzleloading rifles were complex in their structure and operation, modern muzzleloading rifles, such as the in-line rifle described in Knight, U.S. Pat. No. 4,700,499 and the bolt action rifles described in Sachse, U.S. Pat. No. 5,606,817 and Knight et al. , U.S. Pat. No. 5,915,934, have made muzzleloading rifles easier and more enjoyable to use and operate.

A problem with muzzleloading rifles exists in weather proofing the primer to insure consistent ignition. When a primer is exposed to certain weather conditions, such as rain, sleet, or snow, the primer can become damp causing the rifle not to discharge. Thus, developments that provide a seal for the primer increase the consistency of ignition.

Therefore, an objective of this invention is to provide a rifle where the primer is protected from weather conditions.

A further object of the present invention is to provide a disc with a primer to facilitate the loading and reloading of the rifle.

These and other objectives will be apparent to those skilled in the art.

SUMMARY OF THE INVENTION

The present invention provides an improved muzzleloading firearm where a percussion element is sealed from weather conditions. Specifically, the present invention provides a muzzleloading firearm comprising a barrel having a rearward end with a breech plug fastened to the rearward end of the barrel. A nipple extends rearwardly from the breech plug. A receiver is positioned rearward of the barrel and has an opening for receiving a firing element. Within the receiver is a bolt assembly. The firing element, which provides a water tight seal for a percussion element, has an elongated bore extending through from a forward end to a rearward end. The rearward end receives the percussion element and the forward end receives the nipple such that a forward end of the percussion element is in alignment with the nipple.

DESCRIPTION OF THE PREFERRED EMBODIMENT

This invention is an improvement over muzzleloading rifles and can be adapted for use with either in-line muzzleloading rifles such as U.S. Pat. No. 4,700,499 and bolt-action muzzleloading rifles such as U.S. Pat. No. 5,606,817 and U.S. Pat. No. 5,915,934, the structure and function of the prior art which is hereby incorporated by reference.

Figure 1:
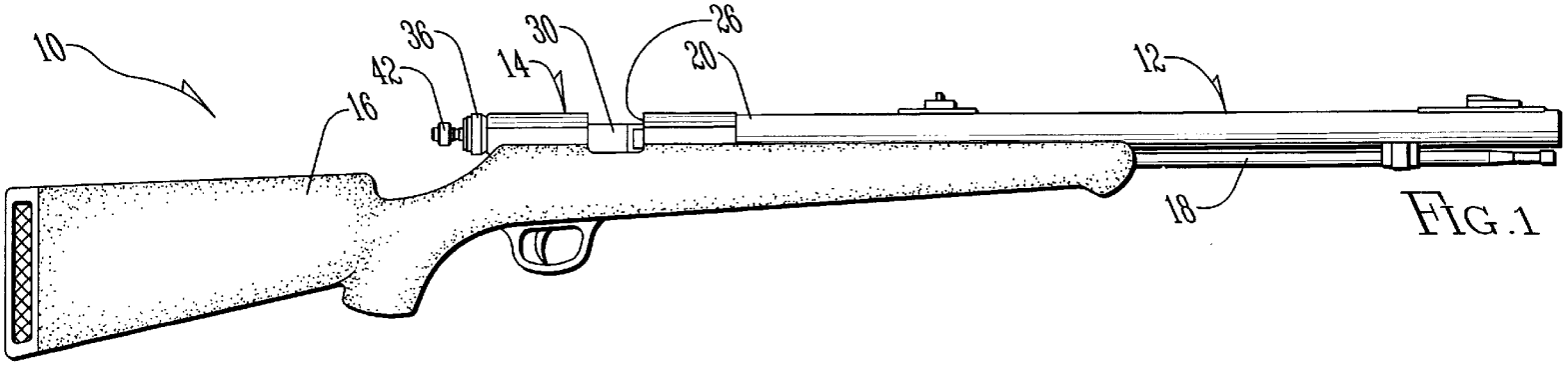
FIG. 1 is a side view of an in-line muzzleloading rifle.

Referring to the drawings, a muzzle-loading rifle of the present invention is designated in its entirety by the reference numeral 10. As shown in FIG. 1, the rifle 10 comprises a barrel 12, a receiver 14, a stock 16, and a ramrod 18. Fastened to the rearward end 20 of the barrel 12 is a breech plug 22 which is threadably mounted within the rearward end 20 of the barrel 12. Extending rearwardly from the breech plug 22 is a nipple 24. The receiver 14 is positioned at the rearward end 20 of the barrel 12 and has an opening 26 for receiving a firing element 28.

Figure 2:
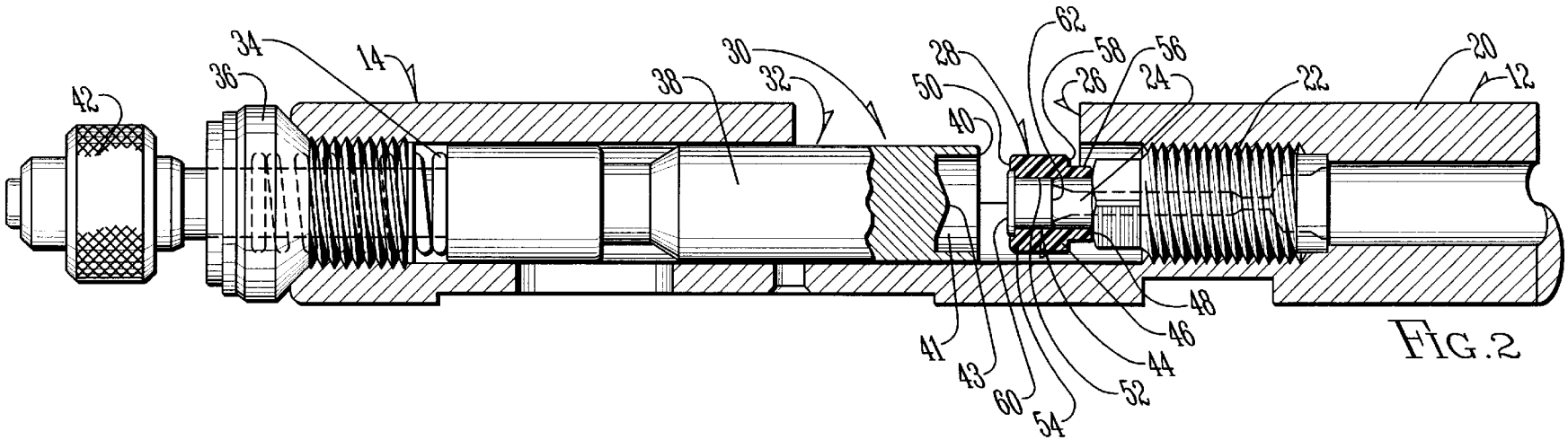
FIG. 2 is a top view of an in-line muzzleloading rifle.

The numeral 30 designates a conventional bolt assembly for an in-line muzzleloading rifle as shown in FIG. 2. The bolt assembly comprises a bolt 32, a bolt spring 34 and an end cap 36. The bolt 32 has a generally cylindrical body 38, a conical head 40 and an elongated tailpiece 42. The spring 34 urges the bolt 32 forward toward a firing position in which the head 40 of the bolt 32 is adapted to strike and ignite a percussion element 44. The head of the bolt has a recess 41 that is formed to receive the firing element 28. The recess has a center protrusion 43 for striking the percussion element 44. The tailpiece 42 extends rearwardly of the bolt body 38 through the end cap 36. The tailpiece 42 functions as a handle and is adapted to be grasped and pulled to slide the bolt rearwardly from its firing position to a retracted (or "cocked") position.

Figure 4:
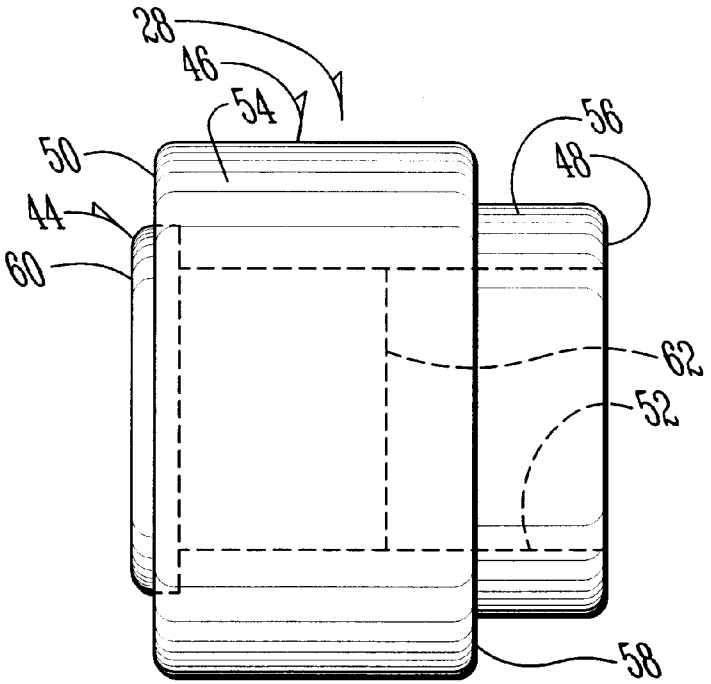
FIG. 4 is a side view of a firing element.
Figure 3:
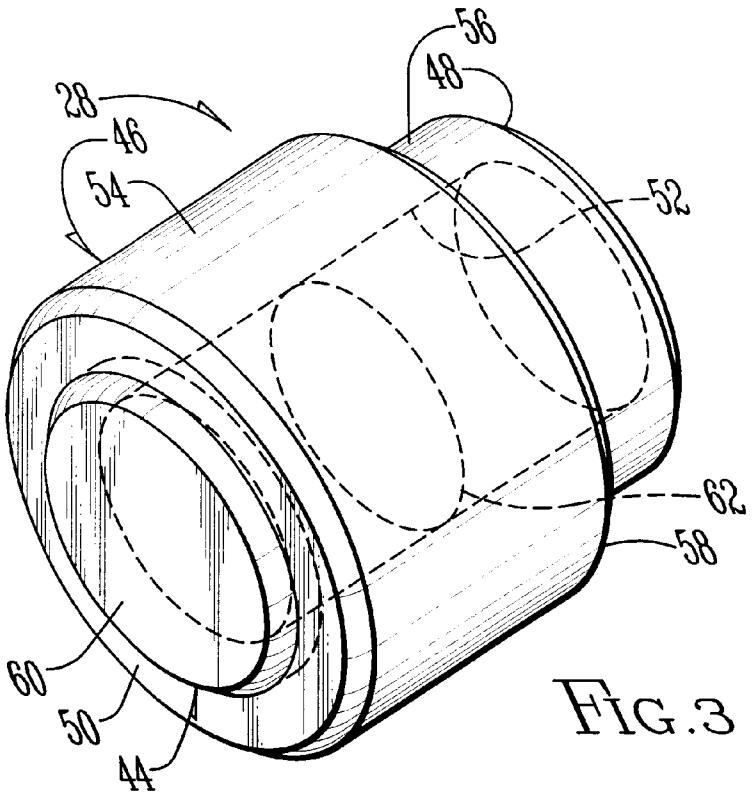
FIG. 3 is a perspective view of a firing element.

The firing element 28 has an elongated generally cylindrical body member 46 having a forward end 48 and a rearward end 50. The body member 46 is made of a hard plastic, such as Fortiflex K50-10-136 High Density Plyethylene (HDPE) or the like and has a center bore 52 extending there through between the forward end 48 and the rearward end 50. As shown in FIGS. 3 and 4, the body member 46 has a rearward portion 56 of reduced diameter, and a shoulder portion 58 on the body member 46 between the forward 56 and rearward 54 portions dwelling in a plane perpendicular to a center elongated axis of the body member 46. Mounted in the rearward end 50 is a percussion element 44. The rearward end 60 of the percussion element 44 protrudes slightly rearwardly from the bore 52 and is adapted ultimately to be engaged by the protrusion 43 of the bolt head 40. The forward end 48 of the bore 52 receives the nipple 24 such that the forward end 62 of the percussion element 44 is in alignment with the nipple 24. Thus, to load the in-line muzzleloading rifle, a firing element 28 with a percussion element 44 mounted in the rearward end 50 of the bore 52, is inserted through the opening 26 in the receiver 14, and is placed on the nipple 24.

Figure 5:
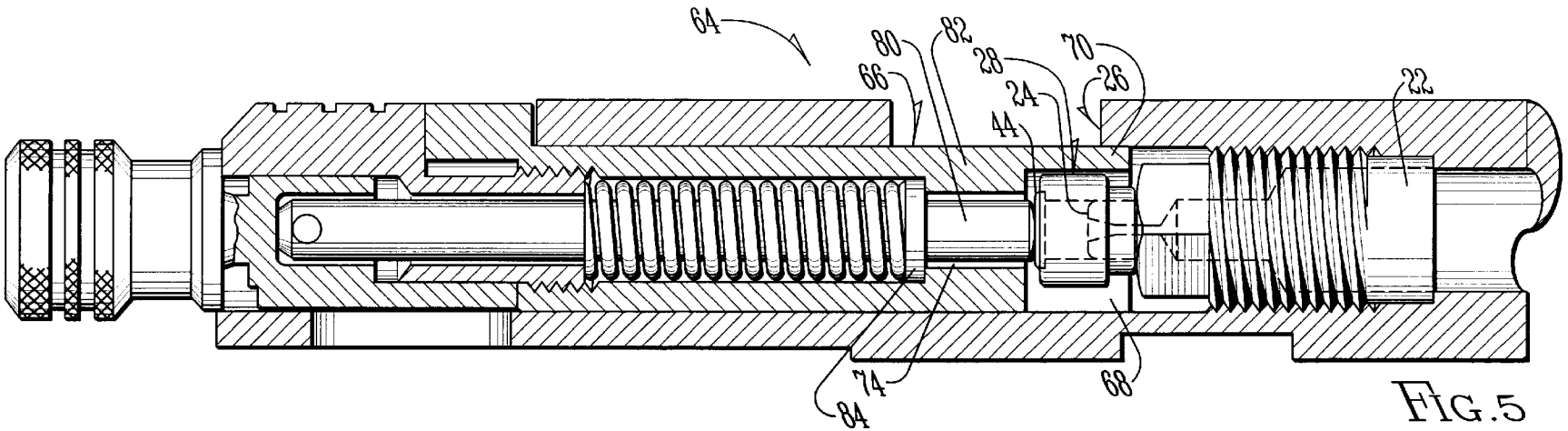
FIG. 5 is a top view of a bolt-action muzzleloading rifle.

In an alternative embodiment, see FIG. 5, and generally for use with bolt-action muzzleloading rifles, the numeral 64 designates a conventional bolt assembly comprised of a tubular sleeve 66 with a chamber 68 located in the forward end 70 of the sleeve 66. The chamber 68 is formed to receive the firing element 28. As shown in FIG. 5, an internal annular shoulder is formed within the center bore 74 to provide rearward support for the chamber 68, and to provide forward support for a striker pin shaft 80. The forward end of the striker pin shaft 80 extends through the bore within shoulder 82, and a shoulder 84 on the striker pin shaft 80 bears against the rearward end of shoulder 82.

When it is desired to fire the rifle 10 or to make it ready for firing, a firing element 28 is deposited in the chamber 68 at the forward end of the sleeve 66 through the opening 26. Preferably, the configuration of the chamber 68 will accommodate the shape of the body member 46 of the firing element 28 so that the firing element cannot be placed in the chamber 68 in an incorrect manner or position. When the rifle is cocked in a conventional manner in accordance with the teachings of U.S. Pat. No. 5,915,934 or U.S. Pat. No. 5,606,817 and the sleeve 66 moves forwardly within the receiver 14 causing the firing element 28 to move forward to receive the nipple 24 in the forward end 56 of the bore 52 of the firing element 28. When fired, the striker pin shaft 80 is urged through the bore 74 and strikes the percussion element 44.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A firing element for use with a firearm having a barrel with a breech plug at a rearward end of the barrel, and a nipple extending rearwardly from the breech plug, comprising:

an elongated cylindrical body member having a forward and a rearward end, a rearward portion of the body member of greater diameter, a forwardmost portion of the body member of reduced diameter, a shoulder portion on the body member between the forwardmost and the rearward portions dwelling in a plane perpendicular to a center elongated axis of the body member, and an elongated bore extending between the forward and the rearward end wherein a percussion element is received in the rearward end of the bore and the nipple is received in the forward end of the bore such that a forward end of the percussion element is in alignment with the nipple.

2. A firearm comprising:

an elongated barrel having a rearward end;

a breech plug fastened to the rearward end of the barrel with a nipple extending rearwardly of the breech plug;

a receiver at the rearward end of the barrel, the receiver having an opening providing access to the nipple;

a bolt assembly positioned within the receiver and having a chamber at the forward end for receiving a firing element;

the firing element having an elongated bore extending through the firing element from a forward end to a rearward end wherein the rearward end of the bore receives a percussion element and the forward end receives the nipple when the bolt assembly is moved to a forward position such that a forward end of the percussion element is in alignment with the nipple; and the firing element having a cylindrical body member with a rearward portion of greater diameter, a forwardmost portion of reduced diameter, and a shoulder portion on the body member between the forwardmost and rearward portions dwelling in a plane perpendicular to a center elongated axis of the body member.

* * * * *